US007292141B2

(12) United States Patent
Staats et al.

(10) Patent No.: US 7,292,141 B2
(45) Date of Patent: Nov. 6, 2007

(54) AUDIBLE ALARM ENHANCEMENT FOR MONITORING SYSTEMS

(75) Inventors: Stephen J. Staats, Wenham, MA (US); James M. Chickering, Georgetown, MA (US)

(73) Assignee: Zoe Medical Incorporated, Topsfield, MA (US)

( * ) Notice: Subject to any disclaimer, the term of this patent is extended or adjusted under 35 U.S.C. 154(b) by 189 days.

(21) Appl. No.: 11/117,937

(22) Filed: Apr. 29, 2005

(65) Prior Publication Data

US 2005/0242942 A1 Nov. 3, 2005

Related U.S. Application Data

(60) Provisional application No. 60/566,461, filed on Apr. 29, 2004.

(51) Int. Cl.
*G08B 1/08* (2006.01)

(52) U.S. Cl. ..... 340/539.12; 340/384.1; 340/384.4; 340/539.1; 340/573.1; 340/825.69; 128/903; 128/904; 600/300; 600/301

(58) Field of Classification Search ..... 340/384.1, 340/384.4, 384.7, 539.1, 539.12, 573.1, 825.49, 340/825.69, 870.01, 313; 128/903, 904; 600/300, 301

See application file for complete search history.

(56) References Cited

U.S. PATENT DOCUMENTS 4,803,625 A 2/1989 Fu et al.
5,339,821 A 8/1994 Fujimoto
5,375,604 A 12/1994 Kelly et al.
5,394,873 A 3/1995 Kraemer et al.
5,417,222 A 5/1995 Dempsey et al.
5,511,553 A 4/1996 Segalowitz
5,544,649 A 8/1996 David et al.
5,553,609 A 9/1996 Chen et al.
5,579,378 A 11/1996 Arlinghaus, Jr.
5,590,648 A 1/1997 Mitchell et al.
5,652,566 A 7/1997 Lambert
5,855,550 A 1/1999 Lai et al.
5,895,371 A 4/1999 Levitas et al.
5,959,529 A 9/1999 Kail, IV
6,053,887 A 4/2000 Levitas et al.
6,057,758 A * 5/2000 Dempsey et al. ..... 340/539.12
6,093,146 A 7/2000 Filangeri
6,221,012 B1 4/2001 Maschke et al.
6,224,548 B1 5/2001 Gopinathan et al.
6,319,200 B1 11/2001 Lai et al.
6,364,834 B1 4/2002 Reuss et al.
6,402,691 B1 6/2002 Peddicord et al.

(Continued)

*Primary Examiner*—Hung Nguyen
(74) *Attorney, Agent, or Firm*—Debra Z. Anderson; Meyer, Unkovic & Scoot LLP

(57) ABSTRACT

An alarm system for a computer-based monitoring system such as a patient medical monitoring system is provided. The system comprises a main processor connected to a first speaker, a second processor communicatively connected to the main processor for exchange of messages; and a second speaker controlled by the second processor. A sensor is communicatively connected to the main processor of the monitoring system for receiving input such as physiologic input from a patient. The second speaker acts as a back-up in the event that the main processor fails to annunciate an alarm or an operator fails to respond to the first alarm within a predetermined time interval. An audible alarm is sounded when the main processor or second processor are not functioning normally.

10 Claims, 3 Drawing Sheets

U.S. PATENT DOCUMENTS 6,416,471 B1 7/2002 Kumar et al.
6,485,416 B1 11/2002 Platt et al.
6,544,173 B2 4/2003 West et al.
6,579,231 B1 6/2003 Phipps
6,616,606 B1 9/2003 Petersen et al.
6,749,566 B2 6/2004 Russ
6,773,397 B2 8/2004 Kelly
6,783,492 B2 8/2004 Dominguez et al.
7,087,016 B2 * 8/2006 Iwabuchi et al. ..... 600/300
2002/0013518 A1 1/2002 West et al.
2002/0044059 A1 4/2002 Reeder et al.
2002/0099273 A1 7/2002 Bocionek et al.
2002/0115914 A1 8/2002 Russ
2003/0009088 A1 1/2003 Korth et al.
2003/0050536 A1 3/2003 Hood et al.
2003/0069481 A1 4/2003 Hervy et al.
2003/0088184 A1 5/2003 Kelly
2003/0171710 A1 9/2003 Bassuk et al.
2003/0195399 A1 10/2003 Phipps
2004/0039263 A1 2/2004 Bardy
2004/0059604 A1 3/2004 Zaleski
2004/0102683 A1 5/2004 Khanuja et al.
2004/0111014 A1 6/2004 Hickle
2004/0117210 A1 6/2004 Brown
2004/0127775 A1 7/2004 Miyazaki et al.
2004/0147818 A1 7/2004 Levy et al.
2004/0152961 A1 8/2004 Carlson et al.
2004/0172290 A1 9/2004 Leven

* cited by examiner

AUDIBLE ALARM ENHANCEMENT FOR MONITORING SYSTEMS

CROSS-REFERENCE TO RELATED APPLICATIONS

This application claims priority to Provisional Application No. 60/566,461, filed Apr. 29, 2004.

FIELD OF THE INVENTION

This invention relates to the field of computer-based monitoring systems that employ audible alarms to alert operators to conditions requiring their attention, including, but not limited to, medical patient monitors.

BACKGROUND INFORMATION

The invention originated in response to the need for reliable audible alarms in critical monitoring environments, such as medical patient monitoring. The monitoring systems deployed in these environments are often based on a system architecture that combines sensing hardware, a processor running a software program with logic for detecting alarm conditions, and hardware for generating audible alarms signals.

In the medical patient monitoring setting, monitoring devices typically use a combination of audible and visual signals to warn clinical caregivers of a condition that requires their attention. A typical instance would be when a measured physiological parameter (such as heart rate) has exceeded or fallen below preset limits. Although this type of system has a degree of built-in redundancy by providing both visual and audible alarms, the audible alarms are most important because the clinicians do not usually focus their attention on the visual display, but are instead preoccupied with a wide range of other tasks. Thus, the failure of an audible alarm might be reasonably expected to lead to the failure of a clinician to notice a condition that should have required attention. In the medical patient monitoring setting, the consequences of failing to notice and respond to such a condition in a timely manner can be serious, including patient injuries or even deaths. Consequently, the reliability of the audible alarm aspect of critical monitoring systems is of major importance.

Most patient monitoring devices incorporate a single speaker for audible alarms. This design has the obvious weakness that if the speaker fails, the audible alarm function will be lost.

In recognition of the potential seriousness of audible alarm failures, manufacturers have taken a variety of approaches. One approach is to treat the speaker as a "critical component", giving it special treatment in the risk analysis, purchasing, manufacturing, and testing processes. While this approach gives due recognition to the importance of having a good quality speaker, it cannot completely eliminate the possibility of speaker failure.

Focusing on the speaker alone does not address the potential for audible alarms to fail due to defects in the signal path to the speaker (such as loose wires or broken traces on a printed circuit board). One way to protect against this is by providing more than one path between the processor chip and the speaker. While this is an improvement, it does not address the potential failure that might occur due to a defect right at the processor chip connection (such as a manufacturing flaw), or the potential failure of the processor chip itself. Even more problematic is the potential for software hang-ups that would keep the processor from generating the signal for an audible alarm in the first place.

Another approach is to provide two independent signal paths from the processor to two independent speakers. This design effectively protects against the possibility of a failure in one of the speakers or one of the signal paths, provided that there is some way of periodically testing both speakers to tell whether one has failed (in which case the system is degraded and reduced to the same condition as if it had only one speaker). This design is still unable to protect against a failure at the origin of the signal path, i.e., the processor chip, or a software hang-up.

Another approach, employed in U.S. Pat. No. 5,652,566 to Lambert (1995), is to add some form of audible feedback sensing, such as placing a microphone inside the monitor in proximity to the speaker, so that the main processor software can tell if the speaker is sounding when it is supposed to. This approach suffers from technical complexity, since it is not a simple task to differentiate appropriate speaker alarm sounds from ambient environmental sounds (which may include alarms from other nearby devices). This approach also fails to protect against hardware or software failures in the processor that is sensing the audible feedback.

Another possible approach would be to utilize two redundant, identical sets of hardware and software for monitoring the alarms. This approach has several significant drawbacks. In a typical patient monitoring device, the main processor runs a large and complex software program that handles the tasks of sampling and storing physiological data, performing signal processing to derive meaningful parameters from the data, and ultimately determining alarm conditions based on complicated rules. Most alarm conditions result from parameters going outside of preset limits. A commonly implemented alarm rule is to sound an audible alarm when a parameter has been outside of its preset limits for a preset length of time. Another commonly implemented alarm rule is to stop the audible alarm when the parameter comes back within limits, or when an operator presses a key on the monitor to silence the audible alarm. Due to the complexity of the entire monitoring task, a design in which two processors run completely independently of one another could wind up generating audible alarms in an asynchronous manner, which would be confusing and frustrating for the operators. A lack of good coordination between the two processors could lead to "race conditions" wherein the operator acknowledges an alarm condition that has been detected by one processor, and moments later the second processor detects the same alarm condition and annunciates a second alarm for the condition that was already acknowledged. Moreover, such a completely redundant design would be expensive, since it would require two equally powerful processors and all their associated circuitry.

There remains a need for reliable alarms in critical computer-based monitoring systems such as patient monitoring devices.

SUMMARY OF THE INVENTION

The present invention fills the above need and provides an alarm system for a computer-based monitoring system. The alarm system comprises a main processor and a first speaker connected to the main processor. A sensor is communicatively connected to the main processor for receiving input, and a second processor is communicatively connected to the main processor for exchange of messages between the two processors. A second speaker is connected to the second processor.

In operation, the main processor sends periodic status messages to the second processor to notify the second processor that said main processor is running, and the second processor sends periodic status messages to said main processor to notify the main processor that said second processor is running. The main processor sets an alarm condition to true based on input from the sensor according to a predetermined alarm logic, and the main processor will generate an audible alarm in the first speaker if the alarm condition is true. The main processor will send a control message to the second processor to generate an audible alarm in the second speaker when the first speaker has been sounding for a predetermined time interval. The second processor will generate an audible alarm in the second speaker if no status message is received within a predetermined time interval or if the control message is received from the main processor. The main processor will generate a visual or audible alarm if the status message from the second processor is not received within a predetermined time interval.

The audible alarm in the second speaker is generated after a predetermined time interval has elapsed between the time when the main processor sets said alarm condition to true and the time when said control message is sent to said second processor. If the alarm condition is set to false after a predetermined time interval, based on input from said sensor, the main processor will send a second control message to the second processor to turn off the second speaker.

In one aspect of the invention, the main processor and the second processor are mounted on the same circuit board. In an additional aspect, the main processor and the second processor are mounted on separate circuit boards.

An operator of an alarm system of the present invention can audibly distinguish between the alarm from the first speaker, the alarm from the second speaker, and the combination of alarms from the first and second speakers.

An operator of an alarm system of the present invention can also distinguish between the following conditions: 1) when no alarm condition exists; 2) an alarm condition that has been in effect for less than a predetermined time; 3) an alarm condition that has been in effect for more than a predetermined period of time; and 4) failure of the main or second processors.

In one embodiment, the first speaker alarm is synchronized with the second speaker alarm and both first and second speakers have matching patterns of alarm tones.

In an additional embodiment, the second processor and the second speaker are added to a previously existing monitoring system.

In an embodiment, the alarm system is an alarm system for a patient medical monitoring system, and the sensor connected to the main processor receives physiologic input from a patient.

BRIEF DESCRIPTION OF THE DRAWINGS

The invention is further illustrated by the following drawings in which.

REFERENCE NUMERALS IN DRAWINGS

10—main processor
12—main speaker on/off signal
14—main speaker
16—main audible alarm signal
20—second processor
22—second speaker on/off signal
24—second speaker
26—second audible alarm signal
30—communications channel
32—input sensor
34—alarm condition signal
40—enhanced alarm system

DETAILED DESCRIPTION OF PREFERRED EMBODIMENTS

The present invention addresses the need for reliable audible alarms in critical computer-based monitoring systems by providing a second processor connected to a second speaker, together with a method for coordinating the audible alarm signals generated by the main processor and the second processor.

Several objects and advantages of the present invention are:

(a) to provide a way for audible alarms to be annunciated even when the main speaker fails;

(b) to provide a way for audible alarms to be annunciated even when there is a defect in the signal path to the main speaker (including a defect in the main processor chip connection);

(c) to provide a way for audible alarms to be annunciated even when there is a software bug in the main processor that causes the program it is running to stop functioning normally (i.e., to "hang"); and (d) to avoid confusing the operator with audible alarm signals that are not coordinated with sensed conditions and operator actions.

The present invention accomplishes these objects and advantages in a simple and cost effective way. To provide the maximum advantage of redundancy, the invention introduces a completely independent second processor and second speaker. The design of the invention allows for the second processor to be of a very simple and inexpensive type, with minimal processing tasks to perform. The second speaker required can also be of a very inexpensive type.

A key aspect of the invention is solving the problem of coordinating between the main and second processors as to when they should generate audible alarms on their respective speakers. To solve this problem, the present invention provides a communications channel between the main processor and the second processor, along with a simple message protocol. The main processor functions as it normally would in a single-speaker system, generating alarm tones to its connected speaker at the times it determines to be appropriate by following its alarm rules. The second processor has only three functions: (1) to turn the second speaker on or off when directed to by the main processor; (2) to turn the second speaker on if no message has been received from the main processor in a set period of time; and (3) to send periodic messages to the main processor to indicate that the second processor is still running.

Figure 1:
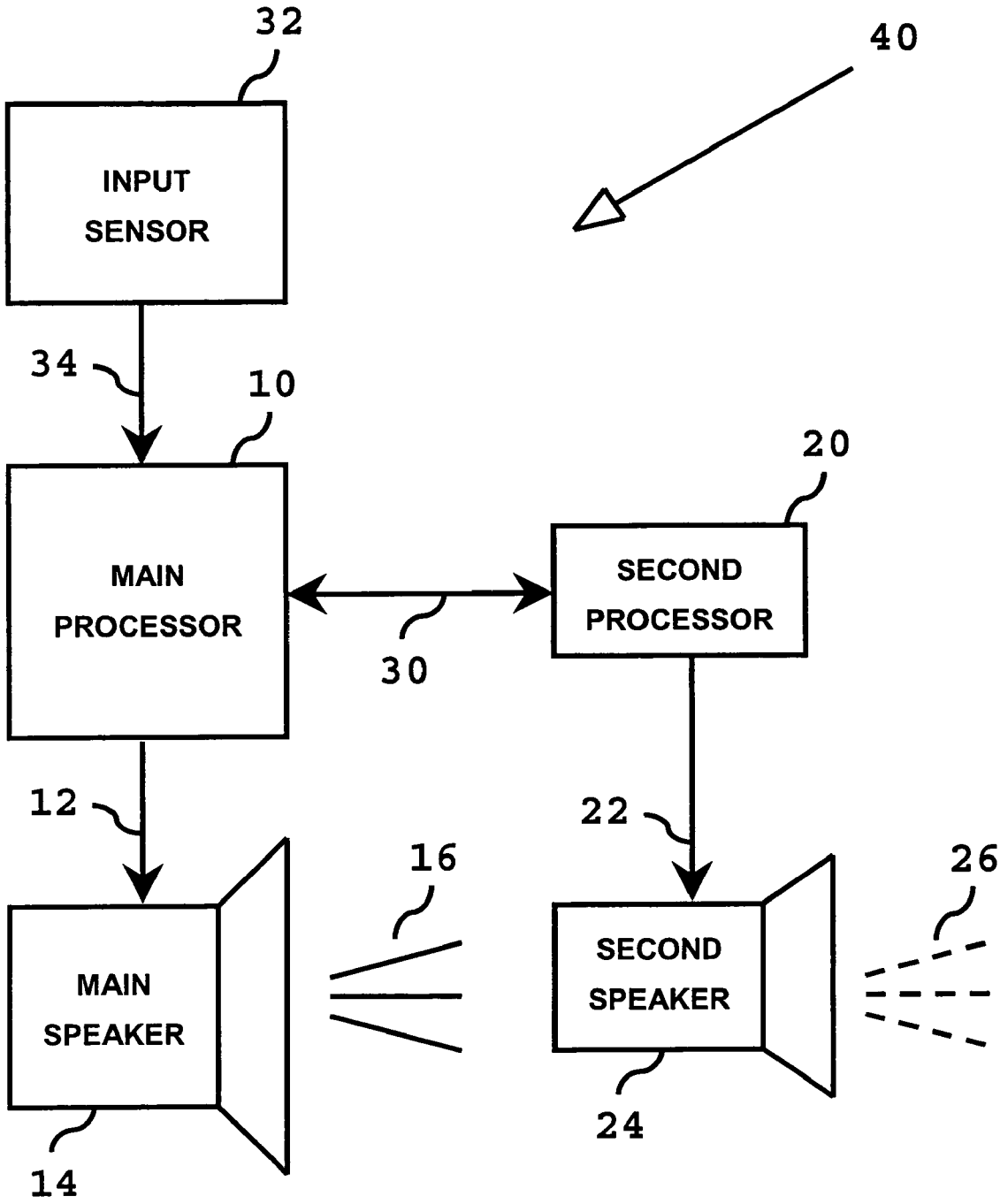
FIG. 1 is a block diagram illustrating an enhanced alarm system in accordance with the principles of the present invention.

FIG. 1 is a block diagram illustrating an enhanced alarm system 40 in accordance with the principles of the present invention. The enhanced alarm system 40 preferably includes a main processor 10 for processing an alarm condition signal 34 generated by an input sensor 32 in order to generate a main speaker on/off signal 12 to control a main speaker 14 which emits a main audible alarm signal 16. The main processor 10 exchanges messages with a second processor 20 by means of a communications channel 30. The second processor 20 generates a second speaker on/off signal 22 to control a second speaker 24 which emits a second audible alarm signal 26. The design of the system preferably includes a choice of components such that an operator can easily distinguish audibly between the following situations: (1) neither the main audible alarm signal 16 nor the second audible alarm signal 26 is sounding; (2) only the main audible alarm signal 16 is sounding; (3) only the second audible alarm signal 26 is sounding; or (4) both the main audible alarm signal 16 and the second audible alarm signal 26 are sounding.

In a preferred embodiment, the enhanced alarm system 40 provides a separate printed circuit board on which only the second processor 20 and the second speaker 24 are mounted. In this embodiment the communications channel 30 can be implemented by means of a wired or wireless data connection to the printed circuit board on which the main processor 10 is mounted. It will be apparent to those skilled in the art that the communication channel 30 could be implemented by a variety of available communications media without changing the principle of the invention. The primary advantage of this embodiment is that it can easily be retrofitted to existing computer hardware used in monitoring systems (such as PC hardware) simply by providing (for example) an RS232 connection to an available RS232 port on the PC and a power connection (either to an unused cable coming from the PC power supply, or to a separate transformer). In this embodiment, the printed circuit board could be mounted inside a commercially available extruded plastic case with openings provided to permit the entrance of the RS232 cable and the power cable.

In an alternative embodiment, the enhanced alarm system 40 provides a single printed circuit board on which the second processor 20, the second speaker 24, and the main processor 10 are mounted. In this embodiment, the communications channel 30 would be implemented by means of traces on the printed circuit board. The primary advantage of this embodiment is that it provides the functionality of the enhanced alarm system 40 at very low cost by adding the second processor 26 and second speaker 24 to the same printed circuit board as the main processor 10, since these additional components are relatively small and inexpensive.

Figure 2:
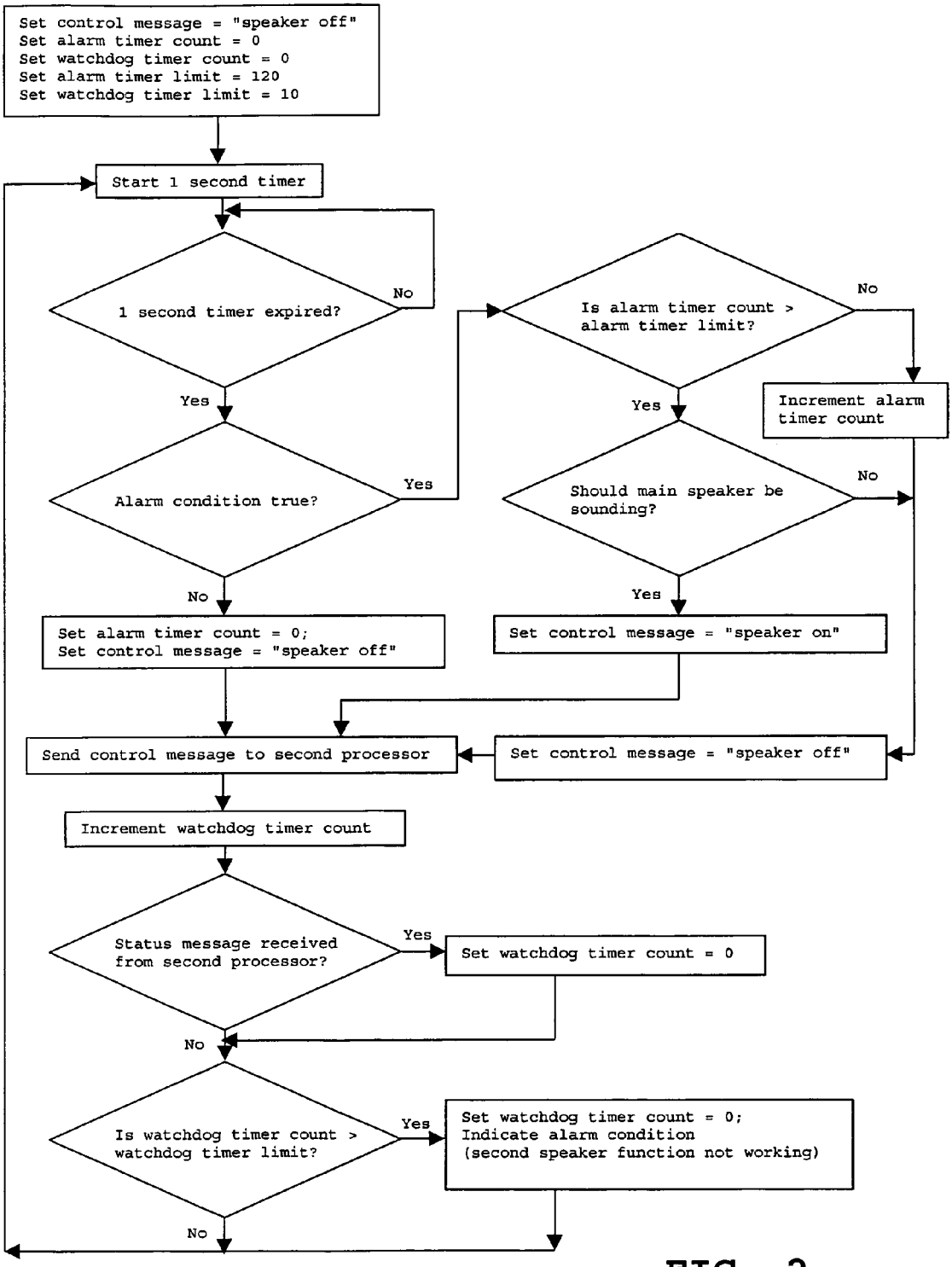
FIG. 2 is a flow chart for software running in main processor.

FIG. 2 provides a flow chart for the software that runs on the main processor 10 to provide the functionality of the enhanced alarm system 40. This software is described more fully below.

Figure 3:
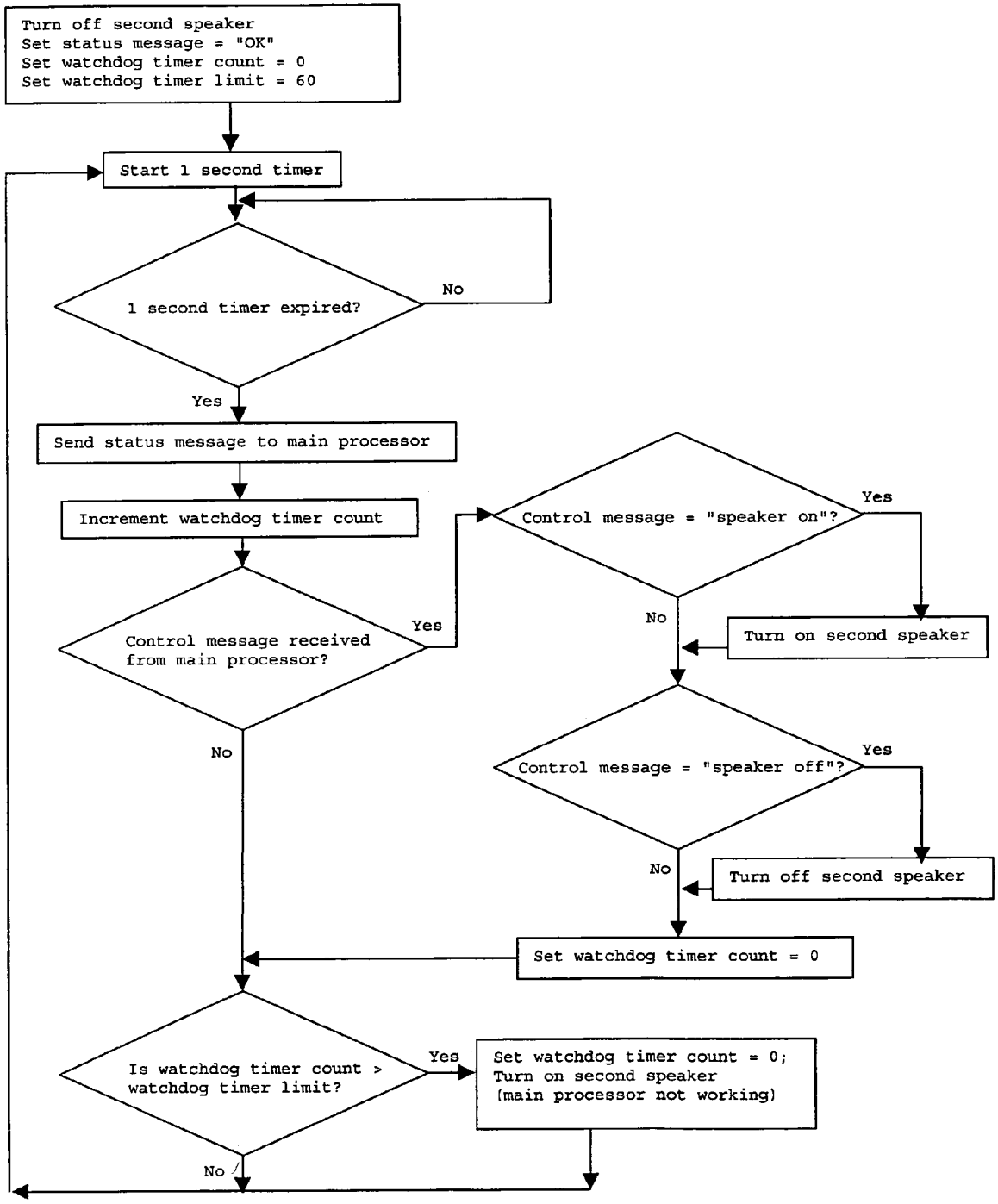
FIG. 3 is a flow chart for software running in second processor.

FIG. 3 provides a flow chart for the software that runs on the second processor 20 to provide the functionality of the enhanced alarm system 40. This software is described more fully below.

Operation

The invention is designed to work as part of a computer-based monitoring system that generates audible alarm signals. The invention does not contribute to a monitoring system's ability to detect alarm conditions reliably, but rather takes this as a starting point. The input sensor 32 may include a variety of conventionally known and manufactured sensors. For example, for use in a medical patient monitor, the input sensor 32 may comprise a variety of physiologic sensing devices. It will be appreciated by those skilled in the art that the input sensor 32 shall incorporate circuitry for allowing the input sensor 32 to effectively interface with the main processor 10. For example, the input sensor 32 may incorporate circuitry to convert analog signals to a digital format that can be processed by the main processor 10. The invention takes as an assumption that the software application running on main processor 10 is capable of working in conjunction with input sensor 32 in order to generate the main speaker on/off signal 12 at times that are appropriate, given the requirements of the monitoring system.

The value of the invention lies in enhancing the overall reliability of the monitoring system by providing a second mechanism for annunciating audible alarms in case the main mechanism fails, and in coordinating the audible alarm behavior of the main and second mechanisms.

The way the invention works is by providing a two-way communications channel 30 between the monitoring system's main processor 10 and a second processor 20, which is provided in an embodiment of the invention. The second processor 20 is connected to a second speaker 24, which is also provided in an embodiment of the invention. The combination of the second processor 20 and second speaker 24 provides a mechanism for generating a second audible alarm signal 26.

The interaction between the monitoring system's main processor 10 and the second processor 20 is controlled by software algorithms which are an integral part of the invention. Since the operation of the invention is essentially described by these algorithms, the following sections describe their operation in detail.

FIG. 2 provides a flow chart for the software that runs on the main processor 10. This flow chart logic can be implemented in any suitable programming language, such as "C++". The flow chart shows only the logic related to the present invention—it is assumed that the main processor is also running a relatively large and complex program that, among other things, handles the detection and annunciation of alarm conditions. Thus, in an operating system that provides for multiple threads of execution, the flow chart represents the logic for a single thread devoted to providing the alarm enhancement functionality.

The flow chart begins with a block showing the initializations that need to be done when the program (or thread) first starts up. These consist of assigning some initial values to a number of variables: (1) setting the content of a control message that will be sent from the main processor to the second processor to "speaker off"; (2) setting the variable alarm timer count to 0; (3) setting the variable watchdog timer count to 0; (4) setting the variable alarm timer limit to 120; and (5) setting the variable watchdog timer limit to 10.

The next block on the flow chart shows a loop structure. The loop begins by setting a one-second timer. When this timer expires, the next step is to query whether alarm condition signal 34 is currently true. To be precise, the query is asking whether the monitoring system is currently detecting any condition that should generate an audible alarm signal. Note that the determination of whether an alarm condition is currently true is made according to all the rules of the alarm detection logic running separately in the main processor 10, and not by the software that is part of the invention. All the invention requires is a means (such as a global variable, or an external function call) for determining whether alarm condition signal 34 is currently true.

If alarm condition signal 34 is not currently true, the variable alarm timer count is reset to 0, and the control message content is set to "speaker off".

If alarm condition signal 34 is currently true, the next step is to check whether the variable alarm timer count has exceeded the variable alarm timer limit. The effect of this step is to provide a delay between the time when the main speaker 14 should start sounding and the time when the second speaker 24 should start sounding. In the embodiment shown in FIG. 2, the delay is taken to be 120 seconds, but clearly this value can be adjusted according to the needs of the application without affecting the underlying principle of operation.

If the variable alarm timer count has not exceeded the variable alarm timer limit, the variable alarm timer count is incremented and the control message content is set to "speaker off".

If the variable alarm timer count has exceeded the variable alarm timer limit, the next step is to query whether the main speaker 14 should be sounding—not whether it is actually sounding, but simply whether it should be sounding. Since audible alarm signals often consist of sound patterns (tones, beeps, chimes, etc.) interspersed with intervals of silence, the intent of this query is to determine whether the main speaker 14 should be sounding at the time when the query is made. Note that the determination of whether the main speaker 14 should be sounding is made according to all the rules of the alarm annunciation logic running separately in the main processor 10, and not by the software that is part of the invention. All the invention requires is a means (such as a global variable, or an external function call) for determining whether the main speaker 14 should be sounding at the time when the query is made. If the alarm annunciation logic in the main processor 10 were not able to tell whether the main speaker 14 should be sounding at any given time, this query could optionally always return a value of "yes", and the invention would still work effectively. The only loss in functionality would be an inability for the second speaker 24 to reproduce the same sound pattern (tones interspersed with silences) that the main speaker 14 is using to annunciate an alarm. In any case, if the query returns a value of "yes" (the main speaker 14 should be sounding), the control message content is set to "speaker on".

The next step is to send the control message to the second processor 20. The content of the control message when the message is sent will tell the second processor 20 whether the second speaker 24 should be on or off, and the second processor 20 will take the appropriate action (as described below in the logic for the software running on the second processor).

The next step is to increment the variable watchdog timer count.

The next step is to check whether a status message has been received from the second processor 20. If so, the variable watchdog timer count is reset to 0.

The next step is to check whether the variable watchdog timer count has exceeded the variable watchdog timer limit. If so, the variable watchdog timer count is reset to 0, and the software indicates an alarm condition. The alarm condition being indicated here is the failure of the second processor 20 to communicate. The software embodied in the invention does not specify how this particular alarm condition is to be annunciated, though presumably it would be through the mechanism normally used to annunciate alarms, i.e., the main speaker 14 and any available visual means. The software embodied in the invention merely requires that some external function call be available for indicating when the second processor 20 has failed to communicate for the preset number of seconds.

At this point, the software loops back to the beginning of the loop and restarts the one-second timer.

The main processor software embodied in the invention is therefore a relatively simple algorithm. To function properly, the algorithm does require that a few functions be provided by the broader software context in which it is running, and it worth noting these:

1) the ability to start a timer;
2) the ability to sense when the timer has expired;
3) the ability to send a control message to another processor;
4) the ability to receive a status message from another processor;
5) a query to tell whether alarm condition signal 34 is currently true;
6) a query to tell whether the main speaker 14 should be sounding; and
7) a function to indicate when the watchdog count exceeds its limit.

These functions are quite typical of computer-based monitoring systems, and are readily implemented by one who is skilled in the art of programming these systems.

FIG. 3 provides a flow chart for the software that runs on the second processor 20. This flow chart logic can be implemented in any suitable programming language, such as "C".

The flow chart begins with a block showing the initializations that need to be done when the program first starts up. The first step is to turn the second speaker 24 off. The next step is assigning some initial values to a number of variables: (1) setting the content of a status message that will be sent from the second processor 20 to the main processor 10 to "OK"; (2) setting the variable watchdog timer count to 0; and (3) setting the variable watchdog timer limit to 60.

The next block on the flow chart shows a loop structure. The loop begins by setting a one-second timer. When this timer expires, the next step is to send the status message to the main processor 10. As mentioned above, this message serves to show the main processor 10 that the second processor 20 is still running.

The next step is to increment the variable watchdog timer count.

The next step is to check whether a control message has been received from the main processor 10. If so, the control message is checked. If the content of the control message is "speaker on", the second processor 20 turns the second speaker 24 on. If the content of the control message is "speaker off", the second processor turns the second speaker 24 off. Whenever a control message is received (regardless of its contents), the variable watchdog timer count is reset to 0.

The next step is to check whether the variable watchdog timer count has exceeded the variable watchdog timer limit. If so, the variable watchdog timer count is reset to 0, and the second processor 20 turns the second speaker 24 on. This provides an indication to the operator that the main processor 10 is not communicating.

At this point, the software loops back to the beginning of the loop and restarts the one-second timer.

The second processor software embodied in the invention is therefore also a relatively simple algorithm. To function properly, the algorithm does require that a few functions be provided by the broader software context in which it is running, and it worth noting these:

1) the ability to start a timer;
2) the ability to sense when the timer has expired;
3) the ability to send a status message to another processor;

4) the ability to receive a control message from another processor; and 5) a function to turn the second speaker 24 on or off.

These functions are quite typical of computer-based monitoring systems, and are readily implemented by one who is skilled in the art of programming these systems.

The above discussion of how the main processor 10 and second processor 20 algorithms operate uses specific values for the basic timing of the various steps. However, these exact values could be modified without changing the underlying principle—for example, a 10-millisecond timer could be employed instead of the one-second timer, the alarm timer limit could be 180 seconds instead of 120 seconds, the main processor watchdog timer limit could be 20 seconds instead of 10 seconds, and the second processor watchdog limit could be 30 seconds instead of 60 seconds. These are implementation details that could vary without changing the underlying structure or purpose of the algorithms.

Similarly, the nature of the data communications between the two processors is open to a variety of implementations. For example, it might be implemented with data security techniques such as packet formatting, sequence numbers, and checksums, in order to reduce the potential for corrupted messages passing between the two processors. Again, these are implementation details that might make sense but do not change the underlying structure or purpose of the algorithms.

The invention provides a way for audible alarms to be annunciated even when the main speaker 14 fails, or when there is a defect in the main speaker on/off signal 12 pathway (including a defect in the main processor chip connection), or when there is a software bug in the main processor 10 that causes the program it is running to stop functioning normally (i.e., to "hang"). The invention provides this audible alarm backup function at very low cost, using inexpensive, readily available components.

The invention also provides a simple solution for adding this audible alarm backup function retroactively to previously deployed monitoring systems, by requiring only a communications connection and a power connection. More and more monitoring systems are making use of PC's, since they offer high performance and low cost. However, the broad consumer market that drives development of the PC creates a situation where the hardware and software components that go into the PC are constantly changing and are not necessarily subject to the same kind of rigorous testing and quality control that are typically applied to proprietary devices that are custom-built for a particular monitoring system application. In a separate printed circuit board embodiment, the invention provides a way to capitalize on the PC's advantages while avoiding the major potential unreliability of PC audio drivers, sound cards, and speakers.

In a single printed circuit board embodiment, the invention provides all the same benefits as the separate printed circuit board embodiment but at an even lower cost, since there is no need to provide housing and mounting hardware for the separate printed circuit board.

Beyond providing an audible alarm backup function by means of a second processor 20 and second speaker 24, the invention provides a number of new and unexpected results that constitute enhancements to the overall reliability of the monitoring system.

One enhancement is that the invention provides a watchdog function whereby the proper functioning of the main processor 10 is continually being checked by an independent second processor 20. This in itself is a significant enhancement to the overall reliability of the monitoring system.

A related enhancement is that the invention provides a watchdog function whereby the proper functioning of the second processor 20 is continually being checked by the main processor 10. This "reverse" watchdog checking capability allows the system to alarm if ever the second processor 20 stops working. The ability to detect when a backup mechanism is not working properly is also a significant enhancement to the overall reliability of the monitoring system.

The mutual watchdog checking between the main processor 10 and the second processor 20 also creates a fail-safe design, in which any single processor failure will result in an audible alarm being generated, either by the main speaker 14 or by the second speaker 24.

A number of significant and unexpected advantages derive from the method used in the invention to coordinate the audible alarm signals generated by the main processor 10/main speaker 14 combination and the second processor 20/second speaker 24 combination. The design of the invention preserves a single main processor 10 with all the alarm logic rules in the software it is running as the "master", while adding to the overall monitoring system a second processor 20 that is very simple and has no role in detecting alarm conditions (other than to detect the failure of the main processor 10). Thus there is no potential for operator confusion arising from independent, asynchronous determination by two processors of when alarms should be sounding, silenced, re-enabled, etc.

The simplicity of the messaging protocol for communications between the main processor 10 and the second processor 20 also makes it easy to implement functions on the main processor 10 for testing the second speaker 24 at power-up time and testing the second speaker 24 upon operator request. These functions enhance the overall reliability of the monitoring system.

A key benefit over the prior art is that instead of relying on any sort of complex feedback sensing to tell if the main speaker 14 is actually sounding when it should be sounding, the invention simply allows a preset number of seconds to elapse between the time when the main speaker 14 should start sounding and when the second speaker 24 should start sounding. This technique is very easy to implement. The underlying idea is that in normal operation, the operators will respond to the audible alarm from the main speaker 14 and take action to silence it. If the audible alarm has not been silenced within a time limit appropriate to the application for which the monitoring system was designed, it could be because the audible alarm is not actually being sounded by the main speaker 14 due to a variety of possible failure conditions. Regardless of whether there is a failure condition or whether the operator simply has not yet responded to the audible alarm, the invention provides for the second speaker 24 to start sounding the second audible alarm signal 26 at this time.

As mentioned above, the enhanced alarm system 40 is preferably implemented with a choice of components such that an operator can easily distinguish audibly between the main audible alarm signal 16, the second audible alarm signal 26, and the combination of these two signals sounding simultaneously. This audible distinguishability, combined with the delayed onset of the second audible alarm signal 26, provides the unanticipated benefit of providing audible information to the operator that a given alarm condition has been sounding for more than the preset number of seconds. Using the example of a 120-second delay, the operator would know that any time the main audible alarm signal 16 and the second audible alarm signal 26 were sounding simultaneously, the alarm condition would have been true for more than two minutes. In some situations, this additional audible information could help an operator to know that the condition was becoming more urgent.

The audible distinguishability also provides a way for the operator to know if the main speaker 14 has failed. Any time the operator hears the second audible alarm signal 26 sounding by itself, it implies a failure of the main speaker 14. The audible distinguishability therefore provides the following audible information to the operator: (1) neither audible signal sounding implies no alarm; (2) main audible alarm signal 16 only sounding implies an alarm condition that has been in effect for less than the preset number of seconds; (3) main audible alarm signal 16 and second audible alarm signal 26 sounding simultaneously implies an alarm condition that has been in effect for more than the preset number of seconds; (4) second audible alarm signal 26 only sounding implies a failure of the main speaker 14.

Another result of the invention design is the ability it provides for synchronizing the alarm tones sounded by the main speaker 14 and the second speaker 24. This particular ability is dependent on the main processor software being able to tell whether the main speaker 14 should be sounding at the time the software embodied in the invention makes this query. When the main processor software is able to tell whether the main speaker 14 should be sounding at the time of the query, the software embodied in the invention will be able to produce in the second speaker 24 a pattern of tones interspersed with silences that matches the pattern being sounded by the main speaker 14. This coordination helps in avoiding confusion for the operator, since the pattern of tones and silences is often used to convey audible information, for instance, about the severity level of an alarm condition. Moreover, in the case when the main speaker 14 is not actually sounding due to some failure condition, the second speaker 24 will independently reproduce the same pattern of tones and silences, and will thus continue to be able to convey the audible information encoded in the pattern, such as the severity level of an alarm condition.

Since the invention does not require any direct user interactions beyond the interactions the user would normally do with the monitoring system, it can be retrofitted to previously deployed monitoring systems with a minimum of operator training. That is, the operators only need to be told about the second speaker 24 and what conditions can lead to the second speaker sounding. The invention does not change the way alarms are detected or annunciated by the main processor 10, nor does it require any change in the way operators are trained to respond to the alarms, although as noted above, the operators may benefit from the additional information of knowing when an alarm has been in effect for more than the preset number of seconds.

The unobvious nature of the invention also derives from the synergistic effect of combining all the advantages mentioned above into a single simple mechanism. The invention confers significant improvements in overall monitoring system reliability by means of its independent second processor 20 and second speaker 24 combination and its fail-safe watchdog functions. At the same time, the invention enhances the ability of the monitoring system to convey audible alarm information by providing a backup means to reproduce patterns of tones and silences. Furthermore, the invention provides a new, unexpected, and valuable result by means of the time delay between onset of the main audible alarm signal 16 and the second audible alarm signal 26, which allows an operator to tell when an alarm condition has been true for more than a preset number of seconds.

Overall, the advantages presented by the invention combine to produce significant enhancement to the reliability of monitoring systems at very low cost and ease of implementation.

Although the description above contains a number of specifications, these should not be construed as limiting the scope of the invention, but as merely providing illustrations of some of the presently preferred embodiments of this invention. For example, the communication between the main processor 10 and the second processor 20 could be implemented using Ethernet, Universal Serial Bus, infrared, or other wireless communication links without changing the underlying structure or purpose of the algorithms. The type of processor used for second processor 20 is also not significant, as long as it can provide the necessary functions, and it is anticipated that ever simpler and less expensive processors will be available as time goes on. For use in a medical device, an exemplary processor is manufactured by Atmel and has Model No. ATMEGA8. The type of device used to provide the second audible alarm signal 26 (speaker, bell, buzzer, piezo electric device, etc.) is also not significant, and it is anticipated that this device will vary based on the demands of the particular environment for which an embodiment of the invention is created. For use in a medical device, an exemplary speaker is available from MG Electronics and has Model No. SBT-1205.

Thus the scope of the invention should be determined by the appended claims and their legal equivalents, rather than by the examples given.

Whereas particular embodiments of this invention have been described above for purposes of illustration, it will be evident to those skilled in the art that numerous variations of the details of the present invention may be made without departing from the invention as defined in the appended claims.

What is claimed is:

1. An alarm system comprising:

a main processor and a first speaker in a computer-based monitoring system;

a sensor communicatively connected to said main processor for receiving input;

a second processor communicatively connected to said main processor for exchange of messages; and a second speaker;

wherein:

A) said main processor sends periodic status messages to said second processor to notify said second processor that said main processor is running;

B) said second processor sends periodic status messages to said main processor to notify said main processor that said second processor is running;

C) said main processor will set an alarm condition to true based on input from said sensor according to a predetermined alarm logic;

D) said main processor will generate an audible alarm in said first speaker if said alarm condition is true;

E) said main processor will send a control message to said second processor to generate an audible alarm in said second speaker when said first speaker has been sounding for a predetermined time interval;

F) said second processor will generate an audible alarm in said second speaker if no status message is received within a predetermined time interval or if said control message is received from said main processor; and G) said main processor will generate a visual or audible alarm if said status message from said second processor is not received within a predetermined time interval.

2. The alarm system of claim 1, wherein said audible alarm in said second speaker is generated after a predetermined time interval has elapsed between a time when the main processor sets said alarm condition to true and a time when said control message is sent to said second processor.

3. The alarm system of claim 1, wherein said main processor and said second processor are mounted on one circuit board.

4. The alarm system of claim 1, wherein said main processor and said second processor are mounted on separate circuit boards.

5. The alarm system of claim 1, wherein an operator of said system can audibly distinguish between the alarm from the first speaker, the alarm from the second speaker, and the combination of alarms from the first and second speakers.

6. The alarm system of claim 5, wherein said operator can distinguish between certain conditions: 1) when no alarm condition exists, 2) an alarm condition that has been in effect for less than a predetermined time, 3) an alarm condition that has been in effect for more than a predetermined period of time, and 4) failure of said main or second processors.

7. The alarm system of claim 1, wherein said first speaker alarm is synchronized with said second speaker alarm and both first and second speakers have matching patterns of alarm tones.

8. The alarm system of claim 1, wherein said second processor and said second speaker are added to a previously existing monitoring system.

9. The alarm system of claim 1, wherein if said alarm condition is set to false after a predetermined time interval, based on input from said sensor, said main processor will send a second control message to said second processor to turn off said second speaker.

10. A patient medical monitoring system comprising:

a main processor and a first speaker in a computer-based patient monitoring system;

a sensor communicatively connected to said main processor for receiving physiologic input from said patient;

a second processor communicatively connected to said main processor for exchange of messages; and a second speaker;

wherein:

A) said main processor sends periodic status messages to said second processor to notify said second processor that said main processor is running;

B) said second processor sends periodic status messages to said main processor to notify said main processor that said second processor is running;

C) said main processor will set an alarm condition to true based on input from said sensor according to a predetermined alarm logic;

D) said main processor will generate an audible alarm in said first speaker if said alarm condition is true;

E) said main processor will send a control message to said second processor to generate an audible alarm in said second speaker when said first speaker has been sounding for a predetermined time interval;

F) said second processor will generate an audible alarm in said second speaker if no status message is received within a predetermined time interval or if said control message is received from said main processor; and G) said main processor will generate a visual or audible alarm if said status message from said second processor is not received within a predetermined time interval.

* * * * *